US006651563B2

(12) United States Patent
Faber et al.

(10) Patent No.: US 6,651,563 B2
(45) Date of Patent: Nov. 25, 2003

(54) IGNITION ELEMENTS AND FINELY GRADUATABLE IGNITION COMPONENTS

(75) Inventors: Gunther Faber, Siegburg (DE); Helmut Zollner, Meerbusch (DE)

(73) Assignee: Dynamit Nobel Artiengesellschaft, Troisdorf (DE)

( * ) Notice: Subject to any disclaimer, the term of this patent is extended or adjusted under 35 U.S.C. 154(b) by 0 days.

(21) Appl. No.: 10/150,059

(22) Filed: May 20, 2002

(65) Prior Publication Data

US 2003/0005989 A1 Jan. 9, 2003

Related U.S. Application Data

(63) Continuation of application No. 09/764,291, filed on Jan. 19, 2001, now abandoned, which is a continuation of application No. 08/809,114, filed on Mar. 13, 1997, now abandoned.

(30) Foreign Application Priority Data

Sep. 13, 1994 (DE) ..... 443 25 21

(51) Int. Cl.[7] ..... F42C 19/12; F42C 19/08; C06C 5/00; D03D 23/00

(52) U.S. Cl. ..... 102/202.11; 102/202; 102/205; 102/275.6; 102/275.11; 149/108.6

(58) Field of Search ..... 149/3, 108.6; 102/202.7, 102/202.9, 202.11, 275.11, 275.6, 205, 202

(56) References Cited

U.S. PATENT DOCUMENTS 2,086,548 A * 7/1937 Handforth ..... 102/10
2,105,674 A * 1/1938 Sosson ..... 102/10
3,211,097 A 10/1965 Foote ..... 102/28
3,249,800 A * 5/1966 Huber ..... 315/111
3,499,386 A 3/1970 Stadler et al. ..... 102/86.5
3,613,597 A 10/1971 Warren et al. ..... 149/2
3,682,727 A 8/1972 Heinzelmann et al. ..... 149/19
3,811,358 A 5/1974 Morse ..... 102/282 X
3,865,008 A 2/1975 Thomas et al. ..... 86/1 R
3,884,307 A 5/1975 Williams ..... 169/59
4,080,227 A 3/1978 Hartzel et al. ..... 149/22
4,145,969 A * 3/1979 Gawlick et al. ..... 102/204
4,220,087 A 9/1980 Posson ..... 102/275.6
4,956,029 A 9/1990 Hagel et al. ..... 149/19.8
5,123,355 A * 6/1992 Hans et al. ..... 102/202
5,394,801 A * 3/1995 Faber et al. ..... 102/202.11
5,602,360 A 2/1997 Sakamoto et al. ..... 102/220
5,763,814 A * 6/1998 Avory et al. ..... 102/202.7

* cited by examiner

*Primary Examiner*—Michael J. Carone
*Assistant Examiner*—Aileen B. Felton
(74) *Attorney, Agent, or Firm*—Antonelli, Terry, Stout & Kraus, LLP

(57) ABSTRACT

An ignition element consists of a combination of first and second ignition components. The first ignition component contains at least one primer, at least on heat-conducting additive selected from the group consisting of zirconium, aluminum, titanium, ferrotitanium, zirconium boride, zirconium hydride and mixtures thereof, at least one oxidant and a binder. The second ignition component contains at least one ingredient that produces hot re4action particles, an oxidant, and a binder.

23 Claims, No Drawings

IGNITION ELEMENTS AND FINELY GRADUATABLE IGNITION COMPONENTS

CROSS REFERENCE TO RELATED APPLICATIONS

This application is a Continuation Application of Ser. No. 09/764,291 now abandoned, which application is a Continuation Application of Ser. No. 08/809,114, filed Mar. 13, 1997 now abandoned.

The invention relates to finely graduatable ignition components for ignition means and ignition elements.

The operation of ignition means and ignition elements is determined essentially by two factors. First, the reaction products should if possible be particle-rich and these particles should be as hot as possible, and second a carrier gas must be produced for the particles so that the particles can penetrate the propellant charge as well as possible. Also, the carrier gas should have a high enough temperature to maintain the particle temperature. Ignition means and ignition elements containing a pyrotechnic fuel based on $B/KNO_2$ or $Ti/BA(NO_3)_2$ or $TiHx/Ba(NO_3)_2$ with $x<1$ or $Zr/Ba(NO_3)_2$ and nitrocellulose, but also ignition means and ignition elements that contain zirconium and potassium perchlorate, generally meet these requirements.

In addition to these fundamental performance requirements, there are other properties that affect the sensitivity and the safety of these ignition means and ignition elements, and are of decisive importance for the quality and applicability of such ignition means and ignition elements. These properties, known as electrical characteristics, are ignition sensitivity (IS), ignition insensitivity (IIS), and ignition delay time (IDT) of the individual components. The ignition insensitivity reflects safety and the ignition sensitivity or ignition delay time reflects the ignition sensitivity of the components. Thus far, components with either sufficiently high ignition insensitivity, but with values too high for the ignition sensitivity, or ignition delay time, i.e. with overly low ignition sensitivity or components with sufficiently low ignition sensitivity and ignition delay time but insufficient ignition insensitivity are known.

The goal of the present invention was to prepare ignition means and ignition elements, hereinafter called ignition elements, which have not only sufficient performance but also finely graduatable values for ignition sensitivity and ignition insensitivity depending on their purpose, without the ignition delay time being substantially impaired.

According to the invention, this goal is achieved by preparing and combining two ignition components with different properties. The first ignition component, known as the filament component, is responsible for the electrical characteristics while the second ignition component, known as the power component, is responsible for the power. Surprisingly, it has been determined that, in order to increase the ignition insensitivity of the filament component without adversely affecting ignition delay time, it is particularly important to ensure a high degree of heat conduction in the filament component. This is achieved according to the invention by an additive able to conduct heat. This heat-conducting additive is chosen from substances known to be capable of absorbing heat and thus drawing heat from the environment. Examples of such substances may be of an inorganic or organic nature, such as metals, metal compounds, or organometallic compounds.

In a first embodiment of the filament component, metals or metal compounds are provided according to the invention as the heat-conducting ingredients. The metals preferably used are zirconium, aluminum, titanium, and/or ferrotitanium. Zirconium is particularly preferred. Borides and hydrides of the aforesaid metals are examples of metal compounds that can be used. Zirconium boride and zirconium hydride are particularly preferred. In addition to these heat-conducting metal additives, the filament components of the ignition elements according to the invention contain at least one primer such as lead azide, diazodinitrophenol, silver azide, tricinate, or picrate, preferably lead picrate, as well as an oxidant such as alkali or alkaline earth nitrates, chlorates, perchlorates, preferably $KClO_3$ and/or $KClO_4$, especially preferably $KClO_4$ and a binder. The binder is responsible not only for binding the individual components but also for the heat resistance of the ignition elements; they should have a heat resistance of >85° C. Binders that are appropriate according to the invention are thus polyvinyl acetate, polysulfone, or polyether sulfone. Polyvinyl acetate is preferably used. While the heat-conducting additive has the function of increasing ignition insensitivity, the primer used is responsible for ensuring the necessary ignition sensitivity. According to the invention, the filament components of the first embodiment are composed of 20 to 80 parts of primer, preferably lead picrate, 20 to 80 parts of a mixture of heat-conducting additive and oxidant, and 1 to 6 parts of binder. The mixture of heat-conducting additive and oxidant is composed of 60 to 90 parts of heat-conducting additive and 10 to 40 parts of oxidant.

In a second embodiment of the filament component, the heat-conducting ingredient provided according to the invention is a heat-conducting primer, preferably silver azide, possibly in combination with other heat-conducting ingredients such as metals, metal compounds, or organometallic compounds. In this embodiment, zirconium, aluminum, titanium and/or ferrotitanium can be used as the metals, and borides and hydrides, preferably zirconium boride and zirconium hydride, can be used as the metal compounds. The particular advantage of using silver azide is that it functions simultaneously as a heat-conducting additive and in its capacity as an primer improves the ignition sensitivity. If silver azide exclusively is used according to the invention, the filament component will consist of 100 parts of silver azide and 1 to 6, preferably 4, parts of binder. Polyvinyl acetate is the preferred binder with the same functions as in the first embodiment.

The power component according to the invention consists of an ingredient that produces hot reaction particles, and of one of the above-listed oxidants, and of one of the aforesaid binders. Zirconium in its various crystal modifications, titanium, or mixtures thereof are suitable ingredients for producing the hot reaction particles. $KClO_3$ and/or $KClO_4$, preferably $KClO_4$ for example, can be used as the oxidant. The binders used are preferably the same substances used for the filament component. The power components according to the invention are composed of 30 to 80 parts of zirconium, titanium, or mixtures thereof, 20 to 70 parts of oxidant, preferably $KClO_4$, and 1 to 6 parts of binder. Preferably, a mixture of 60 parts of zirconium, 40 parts of $KClO_4$, and 4 parts of polyvinyl acetate are used.

The components according to the invention can be used in many different ways alone or in combination. If the filament component according to the invention is combined with the power component according to the invention, finely graduatable ignition elements result.

The ignition elements according to the invention are made for example as follows. The ingredients of the filament component and the power component are screened and suspended in the binder dissolved in an appropriate solvent.

If polyvinyl acetate is used as the binder, butyl acetate is a suitable solvent. This suspension is made dippable, i.e. the viscosity is adjusted accordingly. It is extremely important in this connection for the ingredients not to settle out during dipping. To ensure this, the ignition component suspension is for example homogenized by careful stirring, with safety precautions. Ignition elements are generally made in the form of ignition pellets. A conventional ignition pellet consists for example of two elongate electrically conducting pole carriers (bars) connected by an insulating connector and a connecting filament linking the pole carriers. An ignition pellet element of this type is dipped several times into the ignition component suspension such that the first ignition component surrounds the connecting filament. The dipping process is repeated until a sufficient quantity of filament component mixture has been applied for the application in question. Quantities of 6 to 10 mg for the first ignition component have proven satisfactory. Between the individual dippings, the solvent is allowed to evaporate. After the filament component, the power component is applied in the same manner as a coating around the filament component. For this component as well, the dipping process is repeated until a sufficient quantity of power component mixture has been applied for the application in question. Additive weights that have proven satisfactory for the ignition component for the entire ignition pellet are 50 to 100, preferably 65 to 85 mg. When the ignition pellet has dried for 24 hours, it is given a 20% coating made of the binder in question and dried for a further 48 hours.

The ignition components according to the invention can be used for ignition elements resistant to high temperatures, depending on the binder used. If polysulfone or polyether sulfone for example is used as the binder, the ignition components according to the invention can be used at temperatures of up to 250° C. The ignition elements according to the invention are particularly suited for ignition of propellant charges that require lengthy exposure to a hot flame, and for insensitive propellant charges that require hot metal particles.

The ignition component mixtures given in Table 1 will explain the invention in more detail but without limiting it.

The following are used as filaments:

Filament I: Cr/Ni 2938 Ohm/m, bright, hard, 0.5 mm
Filament II: Cr/Ni 2823 Ohm/m, bright, soft, 0.5 mm
Filament III: Cr/Ni 2827 Ohm/m, bright, hard, 0.5 mm
Filament IV: Cr/Ni 2631 Ohm/m, bright, soft, 0.7 mm
Filament V: Cr/Ni 2649 Ohm/m, bright, hard, 0.7 mm
Filament VI: Cr/Ni 2649 Ohm/m, bright, hard, 0.5 mm

TABLE 1

| Example | 1 | 2 | 3 | 4 | 5 | 6 |
|---|---|---|---|---|---|---|
| picrate (parts) | 50 | 50 | 40 | 40 | 40 | — |
| mixture (parts) | 50 | 50 | 60 | 60 | 60 | 100 |
| (consisting of: | 60 | 60 | 60 | 60 | 60 | 100 |
| heat-conducting additive (parts) and $KClO_4$ (parts) | 40 | 40 | 40 | 40 | 40 | — |
| Mowilith (parts) | 4 | 4 | 4 | 4 | 4 | 4 |
| filament | I | IV | I | II | IV | IV |
| ignition sensitivity (mA) | 233 | 245 | 263 | 272 | 280 | 308 |
| ignition insensitivity (mA) | 546 | 640 | 550 | 587 | 670 | 605 |
| ignition delay time (ms) | 1.04 | 1.27 | 1.10 | 1.09 | 1.27 | 0.69 |

TABLE 1-continued

| Example | 7 | 8 | 9 | 10 | 11 | 12 |
|---|---|---|---|---|---|---|
| picrate (parts) | 50 | 50 | 50 | 40 | 40 | 30 |
| mixture (parts) | 50 | 50 | 50 | 60 | 60 | 70 |
| (consisting of: | 80 | 80 | 80 | 80 | 80 | 80 |
| heat-conducting additive (parts) and $KClO_4$ (parts)) | 20 | 20 | 20 | 20 | 20 | 20 |
| Mowilith (parts) | 4 | 4 | 4 | 4 | 4 | 4 |
| filament | II | IV | III | II | V | VI |
| ignition sensitivity (mA) | 234 | 236 | 238 | 260 | 256 | 304 |
| ignition insensitivity (mA) | 513 | 550 | 499 | 513 | 538 | 579 |
| ignition delay time | 0.80 | 0.84 | 0.73 | 0.76 | 0.77 | 1.02 |

What is claimed is:

1. Ignition element consisting of a combination of first and second ignition components, wherein the first ignition component contains a heat-conducting primer with a heat-conducting additive and a binder, and the second ignition component contains at least one ingredient that produces hot reaction particles, an oxidant, and a binder.

2. Ignition element according to claim 1, wherein the heat-conducting primer is silver azide.

3. Ignition element according to claim 1, wherein inorganic or organic heat-conducting substances are used as the heat-conducting additive.

4. Ignition element according to claim 1, wherein the heat conducting additive is selected from the group consisting of zirconium, aluminum, titanium, ferrotitanium, zirconium boride, zirconium hydride and mixtures thereof.

5. Ignition element consisting of a combination of first and second ignition components, wherein the first ignition component contains at least one primer selected from the group consisting of lead azide, diazodinitro-phenol, silver azide, picrate, and tricinate, at least one heat-conducting additive selected from the group consisting of zirconium, aluminum, titanium, ferrotitanium, zirconium boride, zirconium hydride and mixtures thereof, at least one oxidant and a binder; and the second ignition component contains at least one ingredient that produces hot reaction particles, an oxidant, and a binder.

6. Ignition element according to claim 5, wherein the ingredient producing the hot reaction particles in the second ignition component consists of zirconium in various crystal modifications, titanium, or mixtures thereof.

7. Ignition element according to claim 5, wherein at least one of $KClO_3$ and $KClO_4$ is used as the oxidant.

8. Ignition element according to claim 5, wherein polyvinyl acetate, polysulfone, or polyether sulfone, preferably polyvinyl acetate, is used as the binder.

9. Ignition element according to claim 5, wherein the first ignition component is a filament component and the second ignition component is a power component.

10. Ignition element according to claim 5, wherein the first ignition component contains lead picrate, zirconium $KClO_4$ and polyvinyl acetate, and the second ignition component contains zirconium, $KClO_4$ and polyvinyl acetate.

11. Ignition element according to claim 9, wherein the filament component consists of 20 to 80 parts of picrate, 80 to 20 parts of a mixture of heat-conducting additive and an oxidant comprising $KClO_3$ and/or $KClO_4$, and 1 to 6 parts of binder selected from the group consisting of polyvinyl acetate, polysulfone and polyether sulfone.

12. Ignition element according to claim 11, wherein the mixture of heat-conducting additive and oxidant consists of 60 to 90 parts of heat-conducting additive and 10 to 40 parts of $KClO_4$.

13. Ignition element according to claim 9, the filament component consists of 100 parts of heat-conducting primer and 1 to 6 parts of binder.

14. Ignition component consisting of at least one primer, at least one heat-conducting additive selected from the group consisting of zirconium, aluminum, titanium, ferrotitanium, zirconium boride, zirconium hydride and mixtures thereof, at least one oxidant, and one binder, wherein the at least one heat conduction additive increases the ignition insensitivity of the ignition component without adversely affecting ignition delay time.

15. Ignition component according to claim 14, wherein lead azide, diazodinitro-phenol, silver azide, picrate, or tricinate is used as the primer.

16. Ignition component consisting of a heat-conducting primer with heat-conducting additive selected from the group consisting of zirconium, aluminum, titanium, ferrotitanium, zirconium boride, zirconium hydride and mixtures thereof, and a binder.

17. Ignition component according to claim 16, wherein silver azide is used as the heat-conducting primer.

18. Ignition component consisting of an ingredient that produces hot reaction particles, an oxidant, and a binder.

19. Ignition component according to claim 18, wherein the ingredient producing hot reaction particles consists of zirconium in various crystal modifications, titanium, or mixtures thereof.

20. Ignition component according to claim 14, wherein $KClO_3$ and/or $KClO_4$ is used as the oxidant.

21. Ignition component according to claim 14, wherein polyvinyl acetate, polysulfone, or polyether sulfone is used as the binder.

22. Ignition component according to claim 14, wherein it consists of 20 to 80 parts of picrate, 80 to 20 parts of a mixture of heat-conducting additive, and an oxidant comprising $KClO_3$ and/or $KClO_4$, and 1 to 6 parts of binder selected from the group consisting of polyvinyl acetate, polysulfone and polyether sulfone.

23. Ignition component according to claim 22, wherein the mixture of heat-conducting additive and oxidant consists of 60 to 90 parts of heat-conducting additive and 10 to 40 parts of $KClO_4$.

* * * * *